United States Patent [19]

Benkler

[11] Patent Number: 4,991,323

[45] Date of Patent: Feb. 12, 1991

[54] COMBINED SNOW PLOW WINCH DEVICE

[75] Inventor: Ronald K. Benkler, Bloomington, Minn.

[73] Assignee: Standard Marketing System U.S.A., Inc., Bloomington, Minn.

[21] Appl. No.: 436,309

[22] Filed: Nov. 14, 1989

[51] Int. Cl.[5] ..... E01H 5/04

[52] U.S. Cl. ..... 37/235; 37/231; 37/232; 172/816

[58] Field of Search ..... 37/232, 236, 270, 279, 37/283, 284, 1; 172/264, 265, 816

[56] References Cited

U.S. PATENT DOCUMENTS

| | | | |
|---|---|---|---|
| 1,776,788 | 9/1930 | Gettelman | 37/232 |
| 2,166,424 | 7/1939 | Coates | 37/236 |
| 2,420,591 | 5/1947 | Frame et al. | 37/232 |
| 2,792,650 | 5/1957 | Kenyon | 37/283 X |
| 2,803,071 | 8/1957 | Pochopiea | 37/283 |
| 3,250,026 | 5/1966 | Jocher et al. | 37/232 |
| 3,587,751 | 6/1971 | Schmidt, Jr. | 37/232 X |
| 3,626,614 | 12/1971 | Kahlbacher | 37/232 |
| 3,650,054 | 3/1972 | Hanson | 37/232 |
| 3,775,877 | 12/1973 | Gove, Sr. | 37/232 X |
| 3,845,577 | 11/1974 | Naymik | 37/232 X |
| 3,987,562 | 10/1976 | Deen et al. | 37/232 X |
| 4,074,448 | 2/1978 | Niemela | 37/232 X |
| 4,215,496 | 8/1980 | Wehr | 37/232 X |
| 4,254,564 | 3/1981 | Rath | 37/236 |

*Primary Examiner*—Randolph A. Reese
*Assistant Examiner*—Franco S. DeLiguori
*Attorney, Agent, or Firm*—Merchant Gould Smith Edell Welter & Schmidt

[57] ABSTRACT

A combined snow plow/winch device is provided which includes a mouldboard for plowing snow and a winch for moving loads, both simultaneously mounted to a front of a vehicle. The mouldboard is pivotally mounted to the vehicle for limited movement about a horizontal axis against a biasing member. The winch includes a cable receiving drum, a cable wound about the drum by rotation of the drum, and drive structure for rotating the drum. The winch is mounted to the vehicle above the horizontal rotation axis of the mouldboard. A fairlead is affixed to the mouldboard above and forward of the horizontal rotation axis. During operation of the winch to move objects, the winch cable passes through the fairlead and exerts a force on the mouldboard such that the mouldboard pivots forward against the biasing member, allowing the cable to be straightened between the drum and the object to be moved.

17 Claims, 3 Drawing Sheets

COMBINED SNOW PLOW WINCH DEVICE

TECHNICAL FIELD

This invention relates generally to the field of vehicle accessories, and particularly to a vehicle mounted winch and a vehicle mounted snow plow simultaneously mounted on the vehicle so that the winch can be operated while the snow plow remains on the vehicle.

BACKGROUND

A snow plow and a winch are common vehicle accessories. Previously, a choice had to be made between which accessory was mounted for use on the vehicle. During the cold weather months, there is often a need for both a snow plow and winch to be mounted on the vehicle simultaneously. Problems arise when combining these two accessories on the front of a vehicle because they compete for space and in operation may interfere with each other. The winch is typically located on or near the vehicle frame which typically lies below the top of a snow plow mouldboard. To operate the winch when the snow plow is present, the winch cable must travel up and over the mouldboard. Previous devices employing pulleys and/or guides to accomplish this have proven unsatisfactory. Typically, these devices reduce the horizontal pulling force of the winch because the winch cable does not travel in a straight path between the winch drum and the object to which the cable is attached These devices may also cause increased wearing of the winch cable and any guides employed. Because these devices alter the travel path of the winch cable, they must be designed to withstand the very heavy loads that the winch cable is capable of transmitting.

Prior art devices in this area include the device shown and described in U.S. Pat. No. 4,215,496 which discloses a vehicle bumper permitting simultaneous mounting of a winch and a snow plow. That device threads the winch cable over a snatch block mounted on the plow lift arm to provide vertical clearance between the winch cable and the top of the snow plow. With this arrangement a large load on the cable will place a significant horizontal force on the plow bow member at a large height above the vehicle frame. The resulting stress or torque may, in time, cause the bow to fail. U.S. Pat. No. 2,803,071 discloses an adjustable, manually guidable snow plow. U.S. Pat. Nos. 3,587,751, 2,420,591, 2,166,424, and 1,776,788 disclose snow plows that are designed to allow the blade portion to travel over objects on the plowing surface avoiding damage to the snow plow. Cables are used in these devices to lift or guide the snow plow blade.

The present invention allows the winch to be operated without removing the snow plow. This device allows the winch cable to travel in a straight or very nearly straight path reducing the amount of lost horizontal pulling force in the winch cable. It also reduces the amount of wear on the winch cable and guides. Strength considerations for the portions of the device that allow the cable to travel over the mouldboard are reduced in the present invention because very few parts are subjected to heavy loads during the winching operation.

These and other advantages of the invention over the prior art will become more apparent after reading the description and claims which follow.

SUMMARY OF THE INVENTION

This invention includes a snow plow and a winch mounted on a vehicle so that the winch can be operated without removing the snow plow. The snow plow includes a mouldboard for plowing snow. The mouldboard is hinged to a plow frame behind the mouldboard for rotation about a horizontal pivot axis parallel to the mouldboard. A biasing member included on the snow plow biases the mouldboard to the plowing position. The plow frame is hinged to a plow bracket for attachment to the vehicle. The winch includes a cable, a drum for winding the cable, and a drive means for turning the drum. The winch is mounted above the horizontal pivot axis of the mouldboard. A fairlead is affixed to the mouldboard above and forward of the horizontal pivot axis of the mouldboard. The mouldboard is free to pivot about its horizontal pivot axis against the biasing member as the winch cable passes through the fairlead under load.

DETAILED DESCRIPTION OF THE INVENTION

Throughout the following description, reference will be made to the drawings and the same numerals will be used throughout the several views to indicate the same or like parts of the invention.

Figure 1:
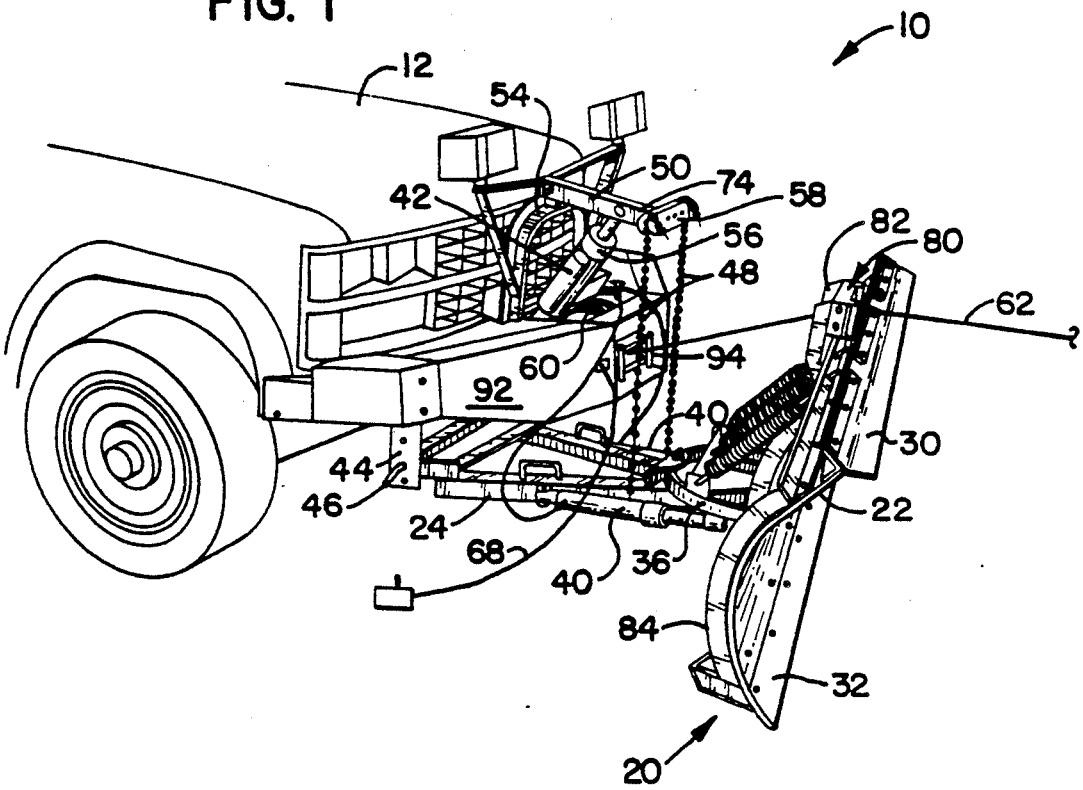
FIG. 1 is a perspective view of a combined snow plow/winch device.
Figure 2A:
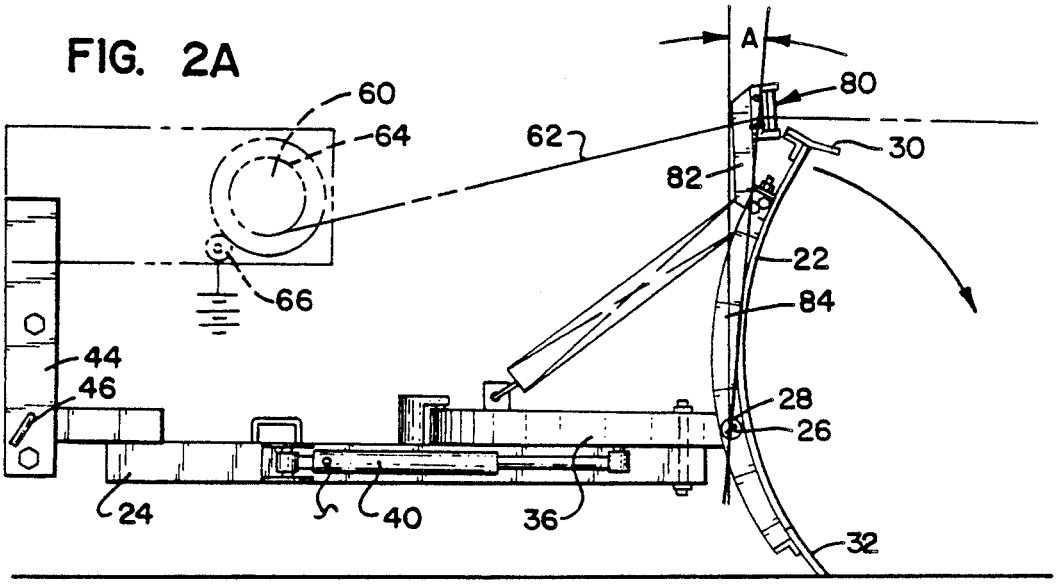
FIGS. 2*a* and 2*b* are side elevational views of the snow plow/winch device of FIG. 1 with the mouldboard shown in the plowing position (FIG. 2*a*) and in the pivoted position (FIG. 2*b*).
Figure 2B:
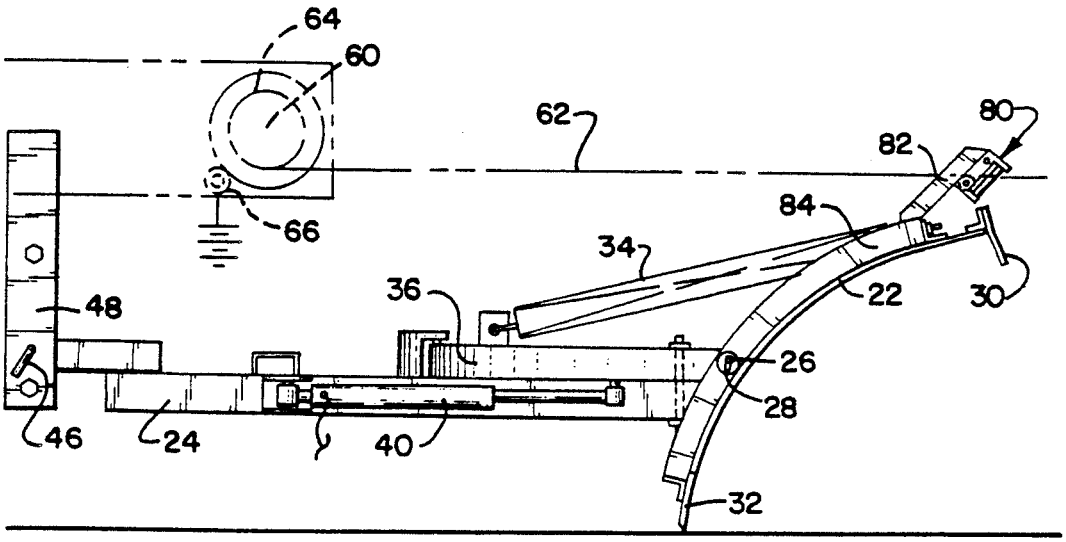

Referring now to FIG. 1, the combination snow plow/winch device 10 includes a snow plow 20 and a winch 60 simultaneously mounted on the front of a vehicle 12. The snow plow includes a mouldboard 22 for plowing snow. The mouldboard is pivotally attached to the front of the plow frame 24 by a frame hinge 26. The mouldboard pivots about a horizontal axis 28 through hinge 26 running parallel to and behind the mouldboard. The axis lies several inches above the ground. The top edge 30 of the mouldboard pivots forward and downward and the bottom edge 32 pivots backward and upward. During the plowing operation, this pivoting feature allows the bottom edge of the mouldboard to trip backwards and travel over objects on the plowing surface that could otherwise damage the snow plow or abruptly stop the vehicle. The snow plow 20 includes a biasing member or spring 34 for biasing the mouldboard to the plowing position as shown in FIG. 2*a*. The mouldboard only pivots against the biasing member after the tripping force of the biasing member has been exceeded. The pivoted position of the mouldboard is shown in FIG. 2*b*. During the plowing operation, this biasing feature returns the mouldboard back to the plowing position after the mouldboard passes over stationary objects on the plowing surface. The biasing feature is also utilized during the winching operation.

A standard vehicle mounted snow plow most often includes the pivoting feature and the biasing feature. To simplify construction, the present invention employs these existing features without modification.

The plow frame 24 includes a turntable 36. The turntable pivots the mouldboard about a vertical axis. Pivoting is controlled by turntable pistons or hydraulic cylinders 40 controlled by the operator. These cylinders are powered by the pump 42 which lifts the plow when driven through suitable valving and conduits. This feature allows the mouldboard to be pivoted about the vertical axis for angled plowing of snow during the plowing operation.

The rear of the plow frame 24 is pivotally attached to the plow bracket 44 by a bracket hinge or locking pins 46. The plow bracket is securely affixed to the vehicle. The plow frame is removably attached to the plow bracket to allow the snow plow to be removed from the vehicle. Pivoting of the plow frame relative to the vehicle, raises and lowers the plow frame between the plowing position and the raised position.

Figure 4:
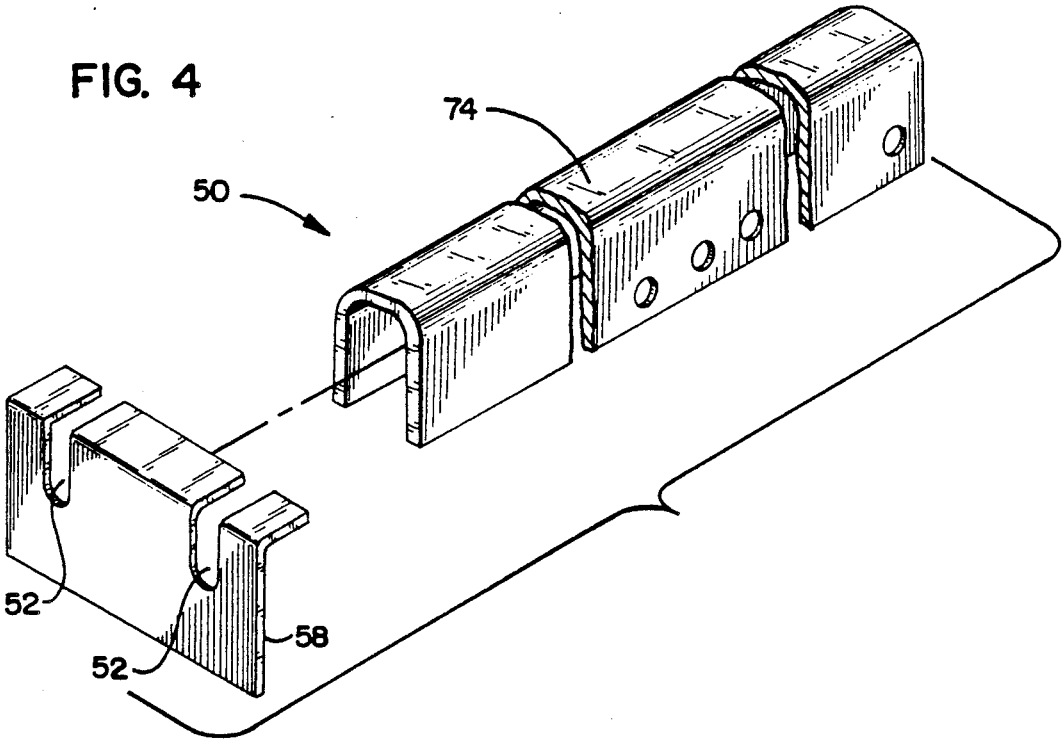
FIG. 4 is an exploded perspective view of the lift arm of the embodiment shown in FIG. 1, but on an enlarged scale.

Two chain members 48 further removably connect the plow frame 24 to the vehicle. These chains connect the lift arm 50 to the plow frame. The chain members are spaced apart by the spaced slots 52 on the lift arm (see FIG. 4). The spaced chains allow room for the winch cable to pass therebetween. As shown in FIG. 4, the slots 52 of the lift arm are located on a transverse plate portion 58 of the lift arm 50 located at the end of an elongated portion 74 of the lift arm. The opposite end of the elongated portion 74 of the lift arm is pivotally connected to a bow 54. The bow is affixed in a generally vertical plane to the vehicle. An elongated lift cylinder 56 is pivotally connected to the bow at one end and further pivotally connects to the lift arm at the other end. Activation of the lift cylinder raises and lowers the plow frame between the plowing position and the raised position.

As best seen in FIGS. 2*a* and 2*b*, the winch 60 includes a cable 62, a drum 64 for winding the cable, and a drive motor 66 for turning the drum. The drive motor is electrically powered and electrically controlled by a remote control cable 68 and switch 70 (see FIG. 1). The winch is affixed to the vehicle by a winch bracket (not shown). Attached to the free end of the cable is a cable hook (not shown) for attaching the cable to the object to be retrieved during the winching operation.

Figure 3:
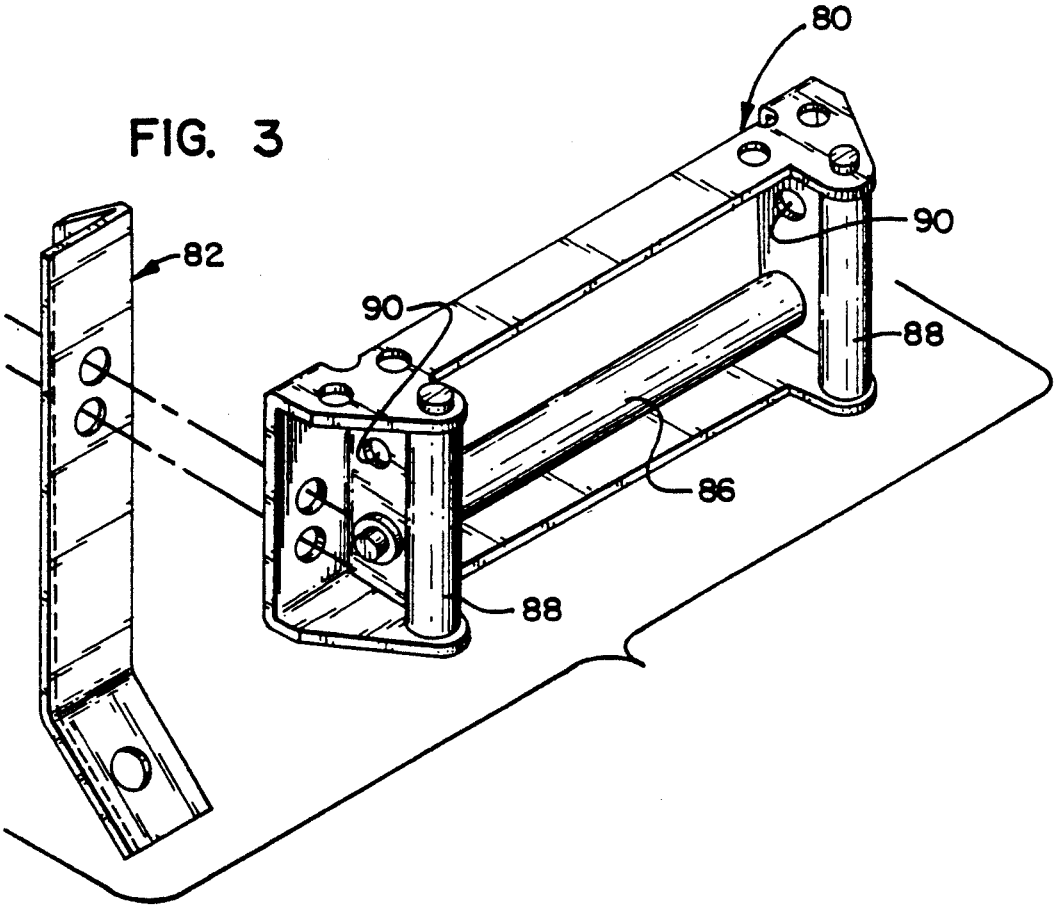
FIG. 3 is an exploded perspective view of a fairlead and mounting bracket of the embodiment shown in FIG. 1, but on an enlarged scale.

The mouldboard 22 includes a frame 84 and a fairlead bracket 82 mounted to the frame. The fairlead 80 is mounted to the fairlead bracket of the mouldboard. The fairlead includes a horizontal roller 86 and two vertical rollers 88. The rollers are sufficiently spaced to allow the cable and cable hook to pass through the fairlead during the winching operation. The fairlead is illustrated in FIG. 3. FIG. 3 shows only one horizontal roller. A second similar roller can be installed above the roller shown in the holes 90 provided. The second roller should be spaced far enough from the first roller to allow the cable hook to freely pass therebetween. The fairlead is mounted above the top edge of the mouldboard and forward (away from vehicle 12 ) of the horizontal pivot axis of the mouldboard. Because of the location of the fairlead relative to the horizontal pivot axis of the mouldboard, a downward force applied by the winch cable to the fairlead, which exceeds the tripping force of the biasing member, will cause the top of the mouldboard to pivot forward and downward to the pivoted position. Proper placement of the fairlead above and in front of the horizontal mouldboard pivot axis is believed to be important to the proper functioning of the device. In a popular commercially available plow system, placement of the fairlead approximately 5 degrees of arc (5/360th of a circle) forward of the vertical line passing through the axis performs well. Placement of the fairlead too close to the vertical plane above the horizontal axis may place heavy loads on the mouldboard during use. Placement of the fairlead too far forward of the axis may interfere with plowing operations and place heavy loads on the fairlead. As the geometry of different snow plows varies, the precise location of the fairlead may need to be adjusted. It is expected that most equipment will perform well with the fairlead placed within the range from approximately 2 degrees of arc to approximately 8 degres of arc forward of the vertical. The arc A is measured between a vertical line passing through the horizontal mouldboard pivot axis and a line passing between the horizontal mouldboard fairlead roller and the horizontal mouldboard pivot axis (See FIG. 2*a*).

Attached to the vehicle is a bumper 92. Included in the bumper is a bumper fairlead 94 mounted forward of the winch. The bumper fairlead is sized sufficiently to allow the cable but typically not the cable hook to pass therethrough.

The winching operation is a two stage process, preparing the invention for retrieval, and retrieval. To prepare the invention for retrieval, the vehicle is pointed directly toward the object and stopped. The lift arm 50 is activated to lower the plow frame 24 to the plowing position. The cable 62 with the attached cable hook is unwound from the drum 64 and manually threaded through the bumper fairlead 94 (if necessary). The cable and cable hook are next threaded between the two chain members 48. Next the cable and cable hook are threaded through the fairlead 80 mounted to the mouldboard. The cable hook is then attached to the object to be retrieved. At this stage of the winching operation, the invention is prepared for retrieval.

To retrieve the object, the electric drive motor 66 is activated through the electric control cable 68 and switch 70 causing the drum 64 to turn and the cable to tighten. The cable will transmit a force on the fairlead mounted on the mouldboard. If the force transmitted by the cable to the fairlead exceeds the tripping force of the mouldboard biasing member 34, the top of the mouldboard will pivot forward and downward from the plowing position to the pivoted position. This position of the mouldboard is illustrated in FIG. 2*b*. In this position, the pivoting of the mouldboard allows the cable to be pulled straight or very nearly straight between the drum and the object to be pulled. Pivoting of the mouldboard during the winching operation to retrieve heavy objects reduces the amount of lost horizontal pulling force of the winch, reduces the amount of wear on the cable and fairleads, and reduces the maximum loads experienced by the cable guiding features. In this position, the cable passes directly from the reinforced vehicle bumper (which is attached directly to the frame) to the object to be retrieved. Unnecessary torque on the snow plow equipment is eliminated and the horizontal pull is directed to the portion of the vehicle best able to withstand the force. The snow plow resting on the ground during winching has a stabilizing effect on the vehicle, as the snow plow blade acts partially as a chock to resist the vehicle from moving toward the object.

The biasing feature will return the mouldboard from the pivoted position toward the plowing position as the force transmitted to the fairlead is lowered. If the force transmitted by the cable to the fairlead does not exceed the tripping force of the mouldboard biasing member, the mouldboard will not pivot during the winching operation. The winching operation is complete when the object has been retrieved.

During periods when the snow plow is removed from the vehicle, during warm weather for example, the winch can be used in the conventional fashion. Should the vehicle become stuck in deep snow when the snow plow is installed, the winch can be utilized to free the vehicle. In this situation, the plow acts to partially clear a path for the vehicle and free the vehicle quickly. In such use, the snow plow may trip forward, causing the snow plow to glide upward somewhat over a portion of the snow. The resulting snow surface allows improved traction for the vehicle wheels and the vehicle is freed more quickly and with less strain on the winch and vehicle.

The invention is not to be construed as limited to the specific embodiment shown in the drawings but is to be limited only by the broad general meanings of the following claims.

I claim:

1. A snow removal and recovery vehicle comprising:

a snow plow including a mouldboard hingedly affixed to a plow frame for limited movement about a generally horizontal pivot axis parallel to the mouldboard against a biasing member, said plow frame removably pivotally affixed to a plow bracket affixed to said vehicle;

a load moving winch including a cable receiving drum, a cable wound about said cable drum by rotation of said drum, and drive means for turning said cable drum, said winch mounted above said generally horizontal pivot axis; and a fairlead affixed to said mouldboard above and forward of said generally horizontal pivot axis and receiving therein said winch cable, whereby said mouldboard is free to pivot against said biasing member by the action of said cable and said cable receiving drum under load, and said fairlead guides said cable over said mouldboard.

2. The vehicle of claim 1, wherein said winch is mounted to said vehicle behind said mouldboard.

3. The vehicle of claim 2, further comprising a second fairlead mounted to said vehicle and guiding said cable between said cable receiving drum and said fairlead affixed to said mouldboard.

4. The vehicle of claim 2, wherein said vehicle further includes a bumper and said winch is mounted within said bumper.

5. The vehicle of claim 4, wherein said bumper includes a bumper fairlead.

6. In a snow plow and recovery device of the type having a vehicle mounted snow plow with a mouldboard mounted to a plow frame for pivotal movement against a biasing member about a generally horizontal pivot axis parallel to the mouldboard, and a vehicle mounted winch with a cable wound about a drum by a drum engaging drive means, said winch mounted generally between said vehicle and said mouldboard, the improvement comprising;

a cable guiding fairlead affixed to said mouldboard above said horizontal pivot axis with said axis located generally between said fairlead and said winch, whereby said mouldboard is free to move against said biasing member under the action of said cable when under load, and said fairlead guides said cable over said mouldboard.

7. The device of claim 6, wherein said mouldboard has a frame and a fairlead bracket, said fairlead bracket affixed to said fairlead and securing said fairlead to said mouldboard frame.

8. The device of claim 6, wherein said winch is electrically powered.

9. The device of claim 8, wherein said winch is electrically controlled by a remote control cable and switch.

10. A vehicle mounted snow plow comprising:

a mouldboard pivotally affixed to a plow frame for limited rotation about a generally horizontal pivot axis parallel to the mouldboard, a plow bracket removably affixed to said plow frame and connected to said vehicle at a frame member thereof;

a lift arm connected to said plow frame and pivotally connected to a bow affixed in a generally vertical plane to said vehicle frame and including an elongated lift cylinder spanning said bow and said lift arm; and a winch affixed to said bow beneath said lift arm and having a driven cable drum with a winch cable wound thereon and a fairlead guide means for guiding said cable over said mouldboard wherein said fairlead is affixed to the upper edge of said mouldboard forward of said generally horizontal pivot axis, whereby said fairlead guide means moves said mouldboard about said horizontal pivot axis when said cable is placed through said fairlead and substantial load is applied to said cable by said driven cable drum.

11. The snow plow of claim 10, wherein said lift arm is connected to said plow frame by two spaced apart chain members, said winch cable passing between said chain

12. The snow plow of claim 10, wherein said fairlead includes a horizontal roller and two vertical rollers, said winch cable passing over said horizontal roller and between said vertical rollers.

13. The snow plow of claim 10, wherein said fairlead includes two horizontal rollers and two vertical rollers, said horizontal rollers and said vertical rollers spaced sufficiently for a winch cable hook to pass between.

14. The snow plow of claim 10, wherein said winch is mounted to said vehicle behind said mouldboard.

15. The snow plow of claim 14, further comprising a second fairlead mounted to said vehicle and guiding said cable between said cable receiving drum and said fairlead affixed to said mouldboard.

16. The snow plow of claim 14, wherein said vehicle further includes a bumper and said winch is mounted within said bumper.

17. The snow plow of claim 16, wherein said bumper includes a bumper fairlead.

* * * * *